US010399734B2

(12) United States Patent
Dalgleish

(10) Patent No.: US 10,399,734 B2
(45) Date of Patent: Sep. 3, 2019

(54) PACKAGING AND METHOD OF MANUFACTURING SAME

(71) Applicant: Visy R & D Pty Ltd, Southbank (AU)

(72) Inventor: Adrian Michael Dalgleish, Whittlesea (AU)

(73) Assignee: Visy R & D Pty Ltd, Southbank, Victoria (AU)

( * ) Notice: Subject to any disclaimer, the term of this patent is extended or adjusted under 35 U.S.C. 154(b) by 0 days.

(21) Appl. No.: 15/268,321

(22) Filed: Sep. 16, 2016

(65) Prior Publication Data

US 2017/0081072 A1 Mar. 23, 2017

(30) Foreign Application Priority Data

Sep. 18, 2015 (AU) ..... 2015903825

(51) Int. Cl.

| | |
|---|---|
| ***B65D 5/24*** | (2006.01) |
| ***B65D 5/64*** | (2006.01) |
| ***B65D 5/56*** | (2006.01) |
| ***B65D 5/68*** | (2006.01) |
| *B31B 120/40* | (2017.01) |
| *B31B 120/10* | (2017.01) |
| *B31B 100/00* | (2017.01) |

(52) U.S. Cl.

CPC ..... *B65D 5/244* (2013.01); *B65D 5/247* (2013.01); *B65D 5/563* (2013.01); *B65D 5/64* (2013.01); *B65D 5/68* (2013.01); *B31B 2100/0024* (2017.08); *B31B 2120/10* (2017.08); *B31B 2120/40* (2017.08)

(58) Field of Classification Search

CPC ..... B65D 5/244; B65D 5/247; B65D 5/563; B65D 5/64; B65D 5/20; B65D 5/241; B65D 25/14; B65D 25/16; B65D 5/242; B31B 2120/40

USPC ..... 229/165, 186, 103.11, 117.27, 123.1, 229/5.84; 220/592.2; 206/524.3

See application file for complete search history.

(56) References Cited

U.S. PATENT DOCUMENTS

| | | | | |
|---|---|---|---|---|
| 5,188,284 A * | 2/1993 | Eisman | B65D 5/64 | 229/110 |
| 5,383,596 A * | 1/1995 | Gulliver | B65D 5/2004 | 229/120.16 |
| 5,402,931 A * | 4/1995 | Gulliver | B65D 5/2004 | 229/120.17 |
| 5,603,996 A * | 2/1997 | Overcash | D21H 19/20 | 229/5.81 |

(Continued)

*Primary Examiner* — Christopher R Demeree

(74) *Attorney, Agent, or Firm* — Schwegman Lundberg & Woessner, P.A.

(57) ABSTRACT

A packaging for foodstuff, including a base blank adapted to be erected into a carton for containing the foodstuff therein, the base blank including a liner paper that forms an internal surface of the carton and which has a release coating applied thereto; a lid blank adapted to form a lid that is securable to the carton so as to enclose the foodstuff within the carton, the lid blank including a liner paper that forms an internal surface of the lid which has a release coating applied thereto such that at least a part of the lid blank remains uncoated to permit bonding of the lid to an uncoated surface of the carton, wherein, the release coating is contactable with the food stuff and capable of providing clean release therefrom.

19 Claims, 7 Drawing Sheets

(56) References Cited

U.S. PATENT DOCUMENTS

| | | | | |
|---|---|---|---|---|
| 5,830,548 | A * | 11/1998 | Andersen | B28B 1/00 206/524.3 |
| 2013/0118946 | A1* | 5/2013 | Suzuki | B65D 25/14 206/524.3 |
| 2016/0176112 | A1* | 6/2016 | Liu | B29C 67/0085 425/174.4 |

* cited by examiner

PACKAGING AND METHOD OF MANUFACTURING SAME

CLAIM OF PRIORITY

This application claims the benefit of priority under 35 U.S.C. § 119 to Australian Patent Application No. 2015903825, filed on Sep. 18, 2015, which is hereby incorporated by reference herein in its entirety.

BACKGROUND OF THE INVENTION

The present invention relates to packaging for the storage and freezing of foodstuffs such as meat and seafood and a method of manufacturing said packaging.

DESCRIPTION OF THE ART

The reference in this specification to any prior publication (or information derived from it), or to any matter Which is known, is not, and should not be taken as an acknowledgment or admission or any form of suggestion that the prior publication (or information derived from it) or known matter forms part of the common general knowledge in the field of endeavour to which this specification relates.

Packaging for storing and freezing foodstuff such as meat and seafood is a typically a combination of a two piece corrugated carton (base and lid) combined with an inner polyethylene bag. For purposes of example only, the below discussion is provided in the context of the freezing and storage of meat products.

The bag's function is to prevent leakage of the meat liquids into the corrugated packaging and also to provide a non-adhesive surface to facilitate easy separation of the frozen meat from the packaging when the meat is thawed or partially thawed for processing by the end-customer.

The draw-back with the use of the inner polyethylene liner bag is "poly entrapment in the meat". Loose folds of the bag may become trapped between the individual meat pieces when the carton is frozen, leading to the bag tearing and leaving fragments of polyethylene bag trapped within the meat when the frozen solid block of meat is removed from the packaging. Poly entrapment presents a choke hazard and has been implicated in a number of deaths. To reduce the possibility of any such hazard, the frozen meat is visually checked after decanting from the packaging for signs of polymer entrapment. The bags are coloured blue to aid in this visual inspection process.

One approach to try and avoid poly entrapment has been to apply an aqueous-based release coating onto the surface of the liner paper (e.g. Kraft paper) in combination with a liner bag. Whilst the aqueous coating system is capable of providing a clean release from the frozen meat due to its low surface energy of adhesion, it cannot be glued. As the coating is applied across the entire web width of the paper, it is not possible to glue the lid and base together if the coating is applied to both the base and the lid.

An alternative approach to aqueous release coating is a polymer liner film which is laminated on the inside surfaces of both the corrugated base and lid. This laminated polymer liner may also be used to provide a non-adhesive surface on the inside of the carton that releases cleanly from the frozen meat when it is decanted before processing by the end customer.

This polymer laminated inside liner typically consists of a combination of Kraft paper combined with an extrusion coated, extrusion laminated or cold glue laminated polymer layer. Polymers can include polyethylene, polypropylene or polyethylene terephthalate (PET). Polypropylene and PET also have the benefit of higher melting points which allow the board to be produced on a standard corrugator at normal production speeds and temperatures, without adhesion to the hot surfaces present in the corrugating process, in particular the hot plates. Polyethylene is considered to have insufficient temperature resistance to allow it to be used in high speed, high volume production of corrugated packaging.

The downside to the use of polypropylene or PET is the difficulty to reliably glue the polymer surface at the speeds required for high speed meat carton erectors.

This poor gluing behaviour is exacerbated by the extremely low storage temperatures (−20° C.) used for meat freezing and storage. Post packing failure of the glue bond and flaps opening during freezer storage is another defect observed with the polymer/paper laminated liner approach.

There have also been reports of some adhesion issues with the polypropylene surface, so it appears that polypropylene may not be quite as good for release behaviour compared to the aqueous coating system.

The polymer extrusion lamination process can only be applied across the entire web width of the surface of the liner paper. It cannot be spot applied to create polymer-free areas for glue adhesion.

It is against this background, and the problems and difficulties associated therewith, that the present invention has been developed.

SUMMARY in a first broad form there is provided a packaging for foodstuff, including:

a) a base blank adapted to be erected into a carton for containing the foodstuff therein, the base blank including a liner paper that forms an internal surface of the carton and which has a release coating applied thereto;

b) a lid blank adapted to form a lid that is securable to the carton so as to enclose the foodstuff within the carton, the lid blank including a liner paper that forms an internal surface of the lid which has a release coating applied thereto such that at least a part of the lid blank remains uncoated to permit bonding of the lid to an uncoated surface of the carton, wherein, the release coating is contactable with the food stuff and capable of providing clean release therefrom.

Typically, the release coating includes:

a) a pre-coat; and b) a top coat which substantially provides the release properties.

Typically, the release coating is selectively applied to the liner paper of the lid blank using a pattern printing process.

Typically, the release coating is selectively applied to the liner paper of the base blank using the pattern printing process.

Typically, the pattern printing process is flexographic or rotogravure printing.

Typically, the printing process controls the application weight of the base coat and the top coat.

Typically, multiple applications of the base coat are applied.

Typically, the release coating is applied using the pattern printing process so that:

a) the base coat provides a uniform surface to maximise the hold of the top coat; and b) the application weight of the top coat is reduced or minimized.

Typically, the release coating is dyed blue to assist in visual inspection of the foodstuff and delineation between coated and uncoated areas.

Typically, the release coating is one of:

a) an aqueous dispersion; and b) solvent borne.

Typically, the lid blank includes a top panel having foldable flaps around an outer periphery thereof and at least a portion of the foldable flaps remain uncoated for bonding to an outer surface of the carton when erected.

Typically, the release coating covers the top panel and a part of the foldable flaps.

Typically, the base blank includes gusseted corners to assist in making the erected carton leakproof.

Typically, the base blank includes:

a) a bottom panel;

b) a first pair of side panels disposed about creases along opposing short edges of the bottom panel;

c) a second pair of side panels disposed about creases along opposing long edges of the bottom panel;

d) folding gusset members disposed in respective corner regions of the base blank, the gusset members configured to fold out in overlapping relation to the first pair of side panels.

Typically, select ones of the gusset members include extending tabs which in use extend across an upper edge of the respective first pair of side panels and engage with opposing tabs to form a continuous flat surface across each respective side panel.

Typically, upper edges of the respective side panels have exposed corrugated flutes when the carton is erected.

Typically, upper edges of the respective side panels include a fold over flap when the carton is erected.

Typically, the base blank and lid blank are manufactured from corrugated paperboard.

Typically, the packaging is poly bag linerless.

Typically, the carton and lid are substantially rectangular.

Typically, the carton and lid are fully recyclable after use.

In a second broad form, there is provided a method of manufacturing a packaging for foodstuff, including:

a) producing a release coated liner paper capable of providing clean release from foodstuff in contact therewith;

b) forming a corrugated sheet using the release coated liner paper;

c) forming a base blank adapted to be erected into a carton for containing the foodstuff therein from the corrugated sheet; and d) forming a lid blank from the corrugated sheet adapted to form a lid that is securable to the carton so as to enclose the foodstuff within the carton, wherein, release coating is at least selectively applied to liner paper that forms an internal surface of the lid such that at least a part of the lid blank remains uncoated to permit bonding to an uncoated surface of the carton.

Typically, the release coating is selectively applied to the liner paper of the lid blank using a pattern printing process.

Typically, the release coating is selectively applied to the liner paper of the base blank using a pattern printing process.

Typically, the release coating is applied using flexographic or rotogravure printing.

Typically, application of the release coating includes:

a) applying a base coat to seal the surface of the liner paper and provide a uniform surface; and b) applying a top coat over the base coat, the top coat providing the release properties.

In a third broad form there is provided a packaging for foodstuff, including:

a) a carton for containing the foodstuff therein that is erected from a base blank, the carton including a release coating applied to an internal surface thereof; and b) a lid securable to the carton so as to enclose the foodstuff within the carton, the lid formed from a lid blank and including a release coating selectively applied to an internal surface of the lid such that at least a part of the internal surface of the lid remains uncoated to permit bonding to an uncoated surface of the carton, wherein, the release coating applied to the base and the lid is contactable with the food stuff and capable of providing clean release therefrom.

In a fourth broad form there is provided a method of packing a foodstuff into a packaging, including:

a) providing a carton that is erected from a base blank, the carton including a release coating applied to an internal surface thereof;

b) packing the foodstuff into the carton;

c) providing a lid securable to the carton so as to enclose the foodstuff within the carton, the lid formed from a lid blank and including a release coating selectively applied to an internal surface of the lid such that at least a part of the internal surface of the lid remains uncoated to permit bonding to an uncoated surface of the carton; and d) securing the lid to the carton by applying an adhesive to the uncoated portion of the lid and bonding it to the uncoated surface of the carton.

BRIEF DESCRIPTION OF THE DRAWINGS

An example of the present invention will now be described with reference to the accompanying drawings, in which.

DETAILED DESCRIPTION

Figure 1:
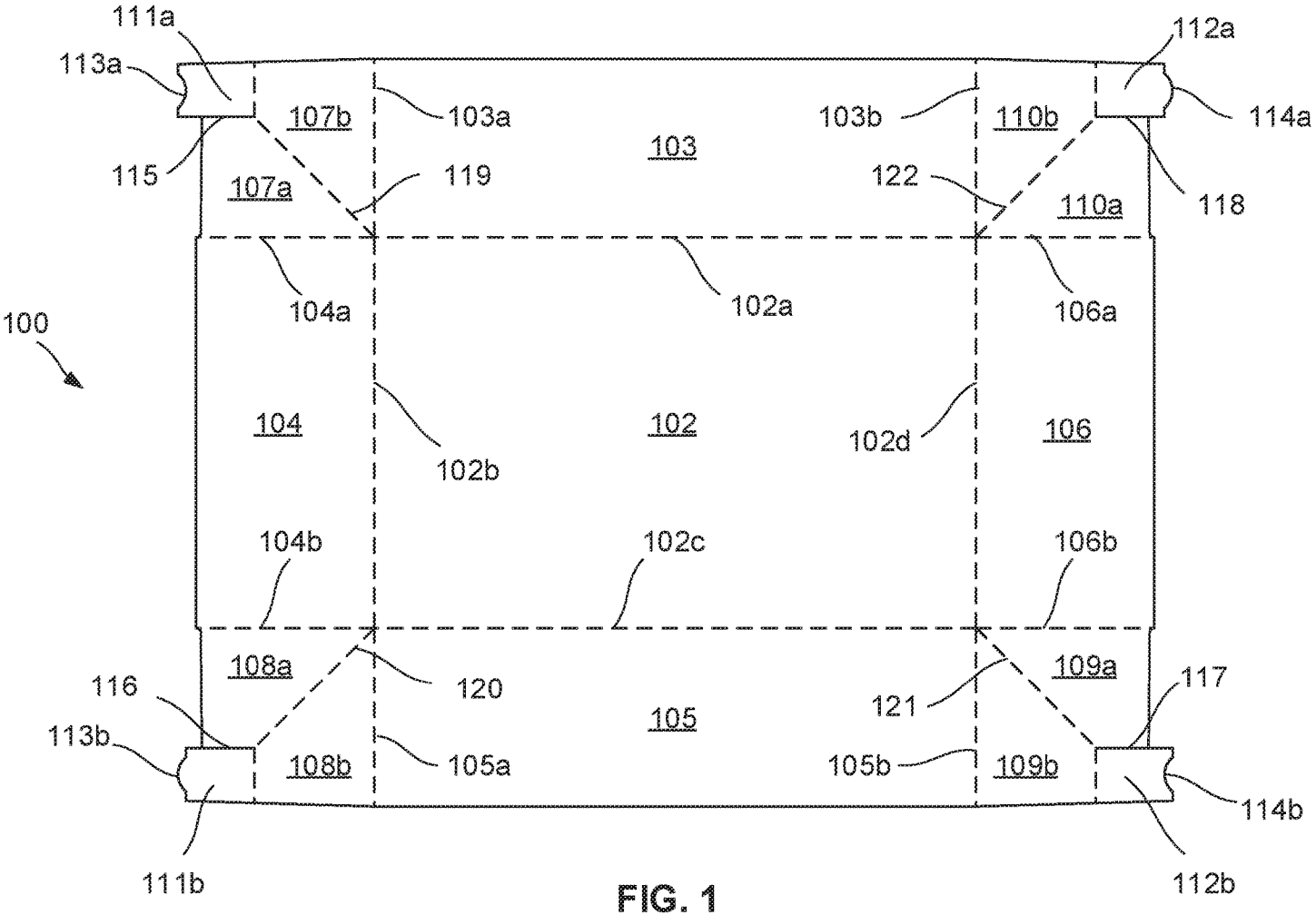
FIG. 1 is a plan view of an example of a base blank adapted to be erected into a carton for containing a foodstuff therein.

An example of a packaging for foodstuff will now be described with reference to FIGS. 1 and 2.

In this example, the packaging includes a base blank 100 adapted to be erected into a carton for containing the foodstuff therein. The base blank shown is designed to form a generally rectangular carton when erected, however this is not essential and it will be appreciated that other carton shapes may be realised by modifying the blank. The packaging may be used for the storage and freezing of various foodstuff including in particular meat, poultry and seafood.

A release coating is applied to at least a portion of a liner paper of the base blank 100 that forms an internal surface of the carton. In one example, the coating is applied across the entire inside surface of the base blank 100, although in other examples the coating may be applied selectively to a portion of the liner paper of the base blank 100 only depending on the technique used to apply the coating.

The packaging further includes a lid blank 200 adapted to form a lid that is securable to the carton so as to enclose the foodstuff within the carton. A release coating is selectively applied to the liner paper of the lid blank 200 that forms an internal surface of the lid. At least a part of the surface of the lid blank 200 remains uncoated to permit bonding to an uncoated surface of the carton. The properties of the release coating make it unsuitable for glue adhesion and therefore if the entire surface of the lid blank is coated, it will not be possible to reliably glue the lid to the carton after the foodstuff has been packed inside the carton. In the example shown in FIG. 2, at least a portion of the lid blank 200 around the outer periphery thereof remains uncoated for glue adhesion as will be described in further detail below.

The release coating applied to the base blank 100 and the lid blank 200 is contactable with the food stuff and capable of providing clean release therefrom. In other words, the release coating prevents adhesion of the coated surfaces of the packaging to the foodstuff (e.g. meat) during the freezing process and during the decanting process from the packaging.

An advantage of the above described arrangement is that the foodstuff can be separated easily from the packaging when the foodstuff is thawed or partially thawed for processing by the end customer. At the same time, the lid is able to be securely bonded to the carton thereby preventing ingress of contaminants into the carton to ensure the quality of the foodstuff contained therein.

A number of further features will now be described.

Referring again to FIG. 1, the base blank 100 will now be described in further detail. The base blank 100 includes a base panel 102 which forms the bottom of the erected carton. A first pair of side panels 103, 105 are disposed about creases (or folding scores or lines of weakness) 102*a*, 102*c* along opposing long edges of the base panel 102. A second pair of side panels 104, 106 are disposed about creases 102*b*, 102*d* along opposing short edges of the base panel 102.

In each corner of the base blank 100 there are foldable gusset members which in use, are designed to leakproof the carton thereby enabling the carton to be poly bag linerless. In the example shown, gusset member 107*a* folds about crease line 104*a* outward of side panel 104. A cut is made along cut line 115 enabling gusset member 107*b* to fold about angular crease line 119 and crease line 103*a* in overlapping relation to gusset member 107*a*.

A similar operation occurs for the remaining gusset members as the carton is erected from the base blank 100. For example, gusset member 108*a* folds about crease line 104*b* outward of side panel 104. A cut is made along cut line 116 enabling gusset member 108*b* to fold about angular crease line 120 and crease line 105*a* in overlapping relation to gusset member 108*a*. Gusset member 109*a* folds about crease line 106*b* outward of side panel 106. A cut is made along cut line 117 enabling gusset member 109*b* to fold about angular crease line 121 and crease line 105*b* in overlapping relation to gusset member 109*a*. Finally, gusset member 110*a* folds about crease line 106*a* outward of side panel 106. A cut is made along cut line 118 enabling gusset member 110*b* to fold about angular crease line 122 and crease line 103*b* in overlapping relation to gusset member 110*a*.

Figure 3A:
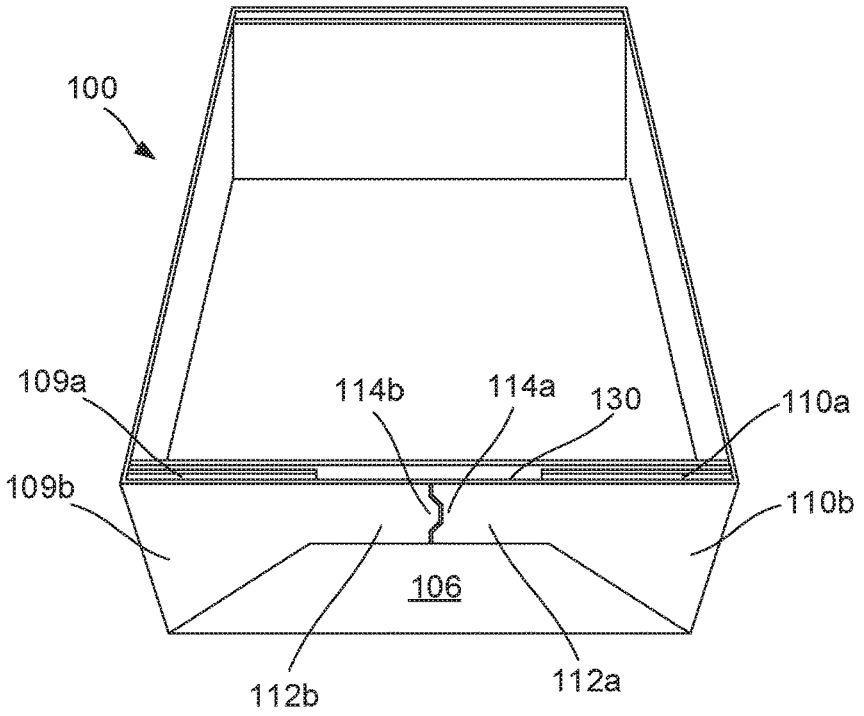
FIG. 3A is a perspective end view of a carton erected from the base blank of FIG. 1.

When erected into a carton, the folded gusset members in each corner are disposed outward of the respective short side panels 104, 106. Consequently, the short side panels 104, 106 no longer present a continuous flat surface which is needed to reliably glue the lid thereto. In order to overcome this problem, the gusset members 107*b*, 108*b*, 109*b*, 110*b* are provided with extended tabs 111*a*, 111*b*, 112*a*, 112*b*. In use, extended tabs 111*a*, 111*b* come together and engage thereby creating a continuous flat surface along the top edge of short panel 104. Likewise, extended tabs 112*a*, 112*b* come together and engage thereby creating a continuous flat surface along the top edge of short panel 106. Mating pairs of extended tabs may have complementary engaging features such as convex portions (113*a*, 114*b*) and concave portions (113*b*, 114*a*) which mate together. An example of the folding gusset and extended tab deployment is shown in FIG. 3A with respect to short side panel 106.

Figure 4:
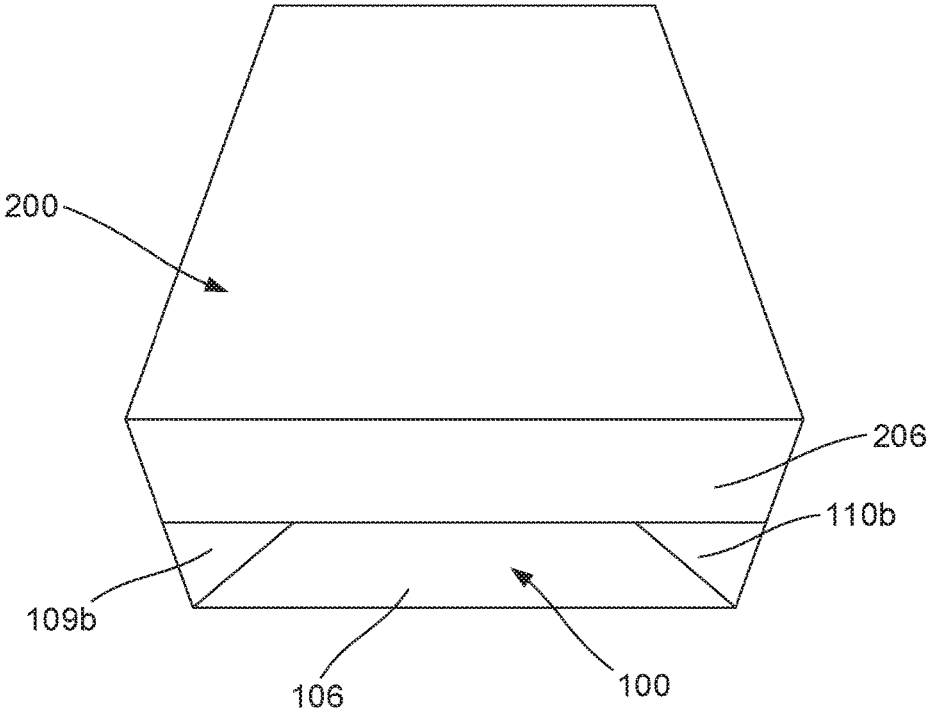
FIG. 4 is a perspective end view of an example of an assembled packaging including a lid secured to the carton.

It will be appreciated therefore that the extended tabs form a flat surface to glue the lid against and to maximise the glued length between the lid and the short side panels of the base carton. An example of a lid 200 glued to a base carton 100 is provided for illustration in FIG. 4 whereby flap 206 is shown bonded to short side panel 106, and in particular to gussets 109*b*, 110*b* and their corresponding extended tabs. Without these tabs, the gluing area in the centre of the short side panels is recessed from the outside folded gusset (as shown by gap 130 in FIG. 3A) and so the lid cannot fully contact the short side panels during the gluing.

In addition to providing a continuous flat surface which enables the lid to be securely bonded thereto, the tabs also serve the purpose of forming a tie which creates tension on the respective gusset members and assists in ensuring that they remain shut as well as helping to stiffen the side panels. In this regard, the short side panels of the carton are strengthened to reduce or minimize side panel bulge during packing and also to reduce or minimize deflection of the side panels during the carton lid gluing process. By reducing or minimizing deflection, more clamping pressure can be applied as the hot glue sets, which in turn provides a better glue bond.

The base blank 100 and lid blank 200 may be constructed from several packaging materials including for example corrugated paperboard (such as cardboard), solid fibre board, folding carton board, paper and films etc.

Figure 2:
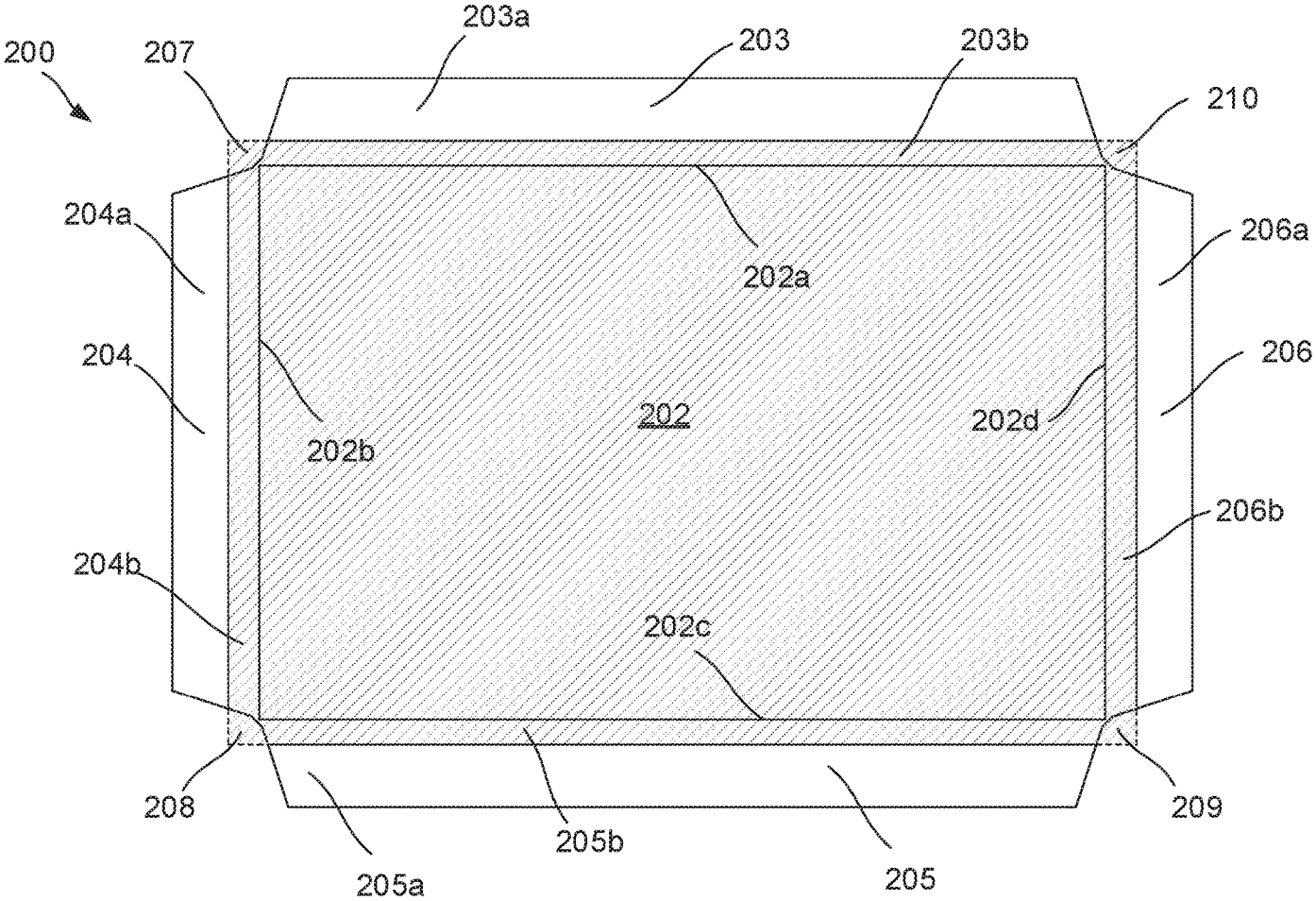
FIG. 2 is an example of a lid blank adapted to engage with the erected base so as to enclose the foodstuff within the carton.

In the example shown in FIG. 1, the release coating is applied across the entire width of the paper forming the inside liner of base blank 100 so that the entire surface of base blank 100 is coated. This may be achieved using a conventional paper coating process including for example rod coating, film press coating, or curtain coating. Alternatively, selected portions of the paper forming the inside liner of the base blank 100 may be coated using a pattern print coating process such as flexographic (flexo) printing, rotogravure printing or possibly lithographic (or offset printing). Flexographic printing allows application weights to be controlled by the use of multiple print stations on the flexo press to build up the coat weight to ensure effective coverage of the base paper. Rotogravure printing has the potential to pattern apply the coating, however the high cost to manufacture the gravure print rolls is a barrier to changing print pattern frequently. Lithographic printing is least preferred as it may provide insufficient application weight to produce an effective surface barrier on rough and porous surfaces such as paper.

The release coating is typically an aqueous based coating system (i.e. an aqueous dispersion), however it may also be solvent borne in other applications.

The release coating may be applied in one or more coatings, however typically at least a pre-coat and a top coat will be applied. The pre-coat is applied to promote adhesion between the coating and the paper. The pre-coat may provide some release property but primarily the release properties are provided by the top coat. The pre-coat acts to seal the paper surface and to provide a uniform surface for application of the top coat which improves the hold-out thereof.

In one example, the pre-coat is dyed blue to provide a visual contrast, so that the coated section can be distinguished from the glued section. The blue dye is also to aid visual detection of any packaging fragments adhering to the meat during the unpacking process.

Typically, the pre-coat is applied with multiple applications to improve application weight and to ensure effective surface coverage of the paper. A typical application weight is at least 4 grams per square meter per unit application.

The top coat is a clear coating and is formulated to maximise release properties. A drawback of the formulation of the top coat having the release properties is that multiple applications of the top coat are not permitted as the top coat will not reliably adhere to itself. This is why it is important therefore to provide a high quality pre-coat to provide a uniform surface for application of the top coat.

The pre and top coat coatings typical consist of some or all of the following:

An emulsion polymer binder which acts as a film former to create a continuous polymer film over the paper surface. The binder also aids as an adhesion promoter to bond the pre-coat to the base paper and the top coat to the pre-coat. Typical binder chemistries are acrylates, styrene-butadiene, styrene-acrylate, poly vinyl acetate, PVDC etc.

A release agent which prevents adhesion of the coated surface to the foodstuff during the freezing process and during the decanting process from the packaging is typically provided in the top coat. The release agent moves to the air-coating surface interface during drying to create anon adhesive surface layer. Typical release agents can be waxes, stearates and other hydrophobic materials. It will be appreciated therefore that in addition to providing release properties, the coating will also act as a barrier against water which can assist in waterproofing the packaging.

In addition, mineral fillers with high aspect ratios such as clays and talcs may be provided in the coating to create a physical barrier.

Referring back to FIG. 2, the lid blank 200 shall now be described in further detail. The lid blank 200 includes atop panel 202 bordered by foldable flaps on each side thereof. Foldable flaps 203, 204, 205, 206 fold about respective crease lines 202*a*, 202*b*, 202*c*, 202*d* respectively to form a lid that can be assembled with the carton when packing the foodstuff. The release coating (depicted by hatched lines in FIG. 2) is selectively applied to the paper liner that forms an internal surface of the lid blank 200 such that at least apart of the surface of the lid blank 200 remains uncoated to permit bonding to an uncoated surface of the carton. In the example shown, the release coating is selectively applied to the top panel 202 and to portions 203*b*, 204*b*, 205*b*, 206*b* of the flaps 203, 204, 205, 206. In other words, the coating area is extended slightly past the creases 202*a*, 202*b*, 202*c*, 202*d*. Coated corner regions 207, 208, 209, 210 are cut away from the blank prior to erection of the lid.

The composition of the release coating applied to the paper liner of the lid blank 200 may be the same as previously described and in one example, is pattern printed using a flexographic process which can apply coating that can be variable in dimension in both X and Y axes, allowing at least a part of the lid blank 100 to remain uncoated.

In this respect, an outer periphery of the lid blank 200 remains uncoated, such as outer portions 203*a*, 204*a*, 205*a*, 206*a* of the flaps 203, 204, 205, 206. A suitable adhesive such as glue can be applied to these uncoated portions of the lid blank 200 and used to bond the lid to carton. The ability to apply the release coating using pattern printing enables selective portions of the blank to be coated, while leaving other portions uncoated for gluing.

Figure 3B:
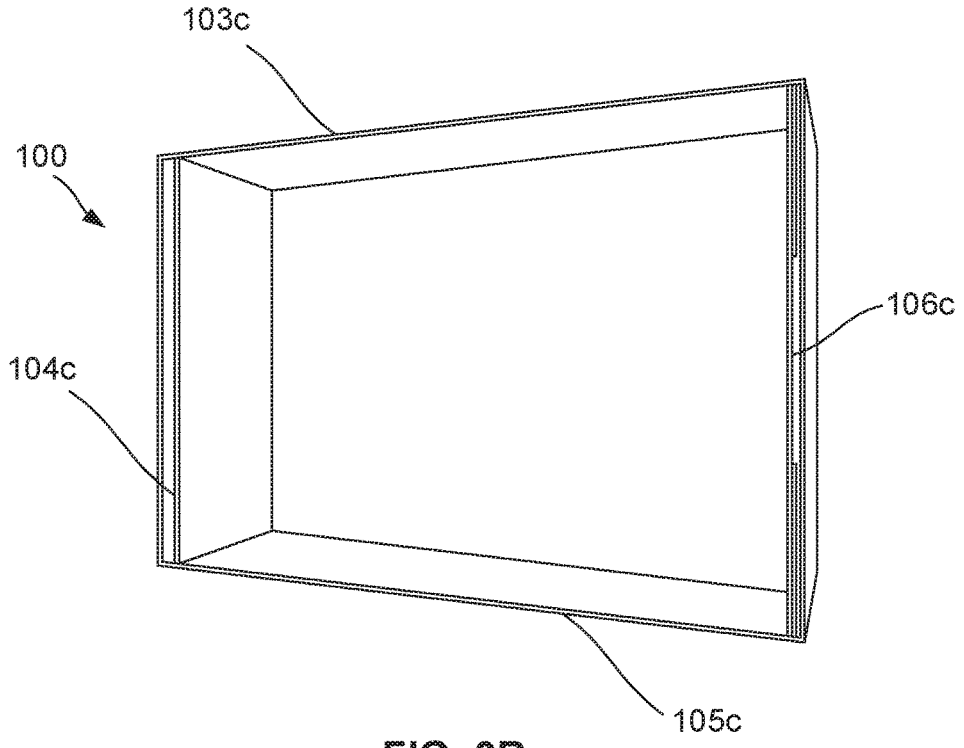
FIG. 3B is a perspective top view of the carton of FIG. 3A.
Figure 5:
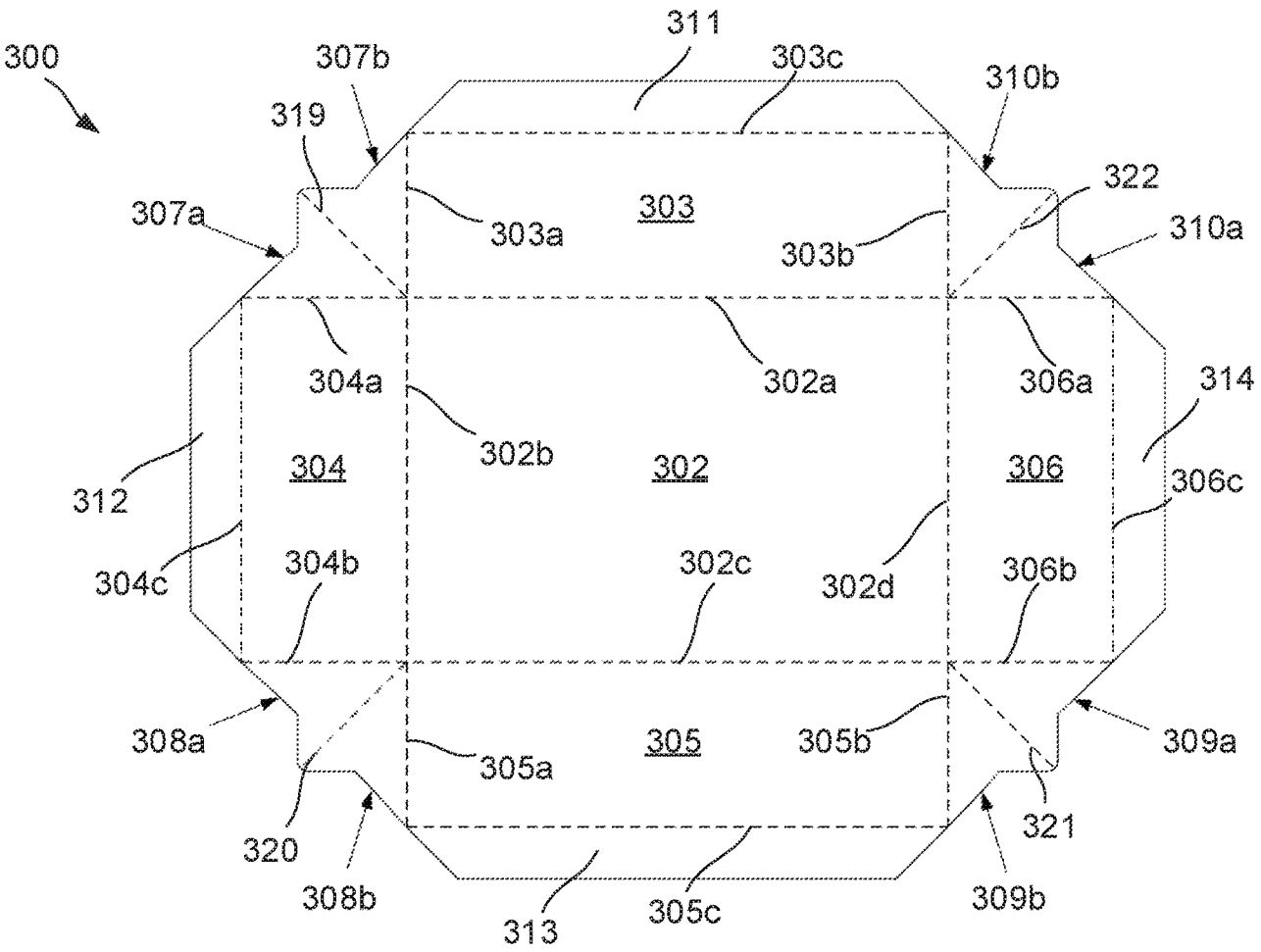
FIG. 5 is another example of a base blank adapted to be erected into a carton for containing a foodstuff therein.

In the example of a base blank 100 described thus far, as shown in FIG. 3B, the top edges 103*c*, 104*c*, 105*c*, 106*c* of the side panels 103, 104, 105, 106 have exposed corrugated flutes. This arrangement may be advantageous because it is easier and faster to glue. However, in an alternative example as shown in FIG. 5, a fold over flap design may be used to conceal the corrugated flutes.

In this example, there is provided a base blank 300 which includes a base panel 302 which forms the bottom of the erected carton. A first pair of side panels 303, 305 are disposed about creases (or folding scores or lines of weakness) 302*a*, 302*c* along opposing long edges of the base panel 302. A second pair of side panels 304, 306 are disposed about creases 302*b*, 302*d* along opposing short edges of the base panel 302. Fold over flaps 311, 312, 313, 314 are provided adjacent to each side panel 303, 304, 305, 306 respectively exterior to crease lines 303*c*, 304*c*, 305*c*, 306*c*.

The base blank 300 further includes corner gussets (307*a*, 307*b*), (308*a*, 308*b*), (309*a*, 309*b*) and (310*a*, 310*b*) which assist in leakproofing the erected carton.

Gusset members 307*a*, 307*b* fold relative to each other about angular crease line 319 while folding about side panels 303, 304 about crease lines 303*a*, 304*a* respectively. Gusset members 308*a*, 308*b* fold relative to each other about angular crease line 320 while folding about side panels 304, 305 about crease lines 304*b*, 305*a* respectively. Gusset members 309*a*, 309*b* fold relative to each other about angular crease line 321 while folding about side panels 305, 306 about crease lines 305*b*, 306*b* respectively.

Finally, gusset members 310*a*, 310*b* fold relative to each other about angular crease line 322 while folding about side panels 303, 306 about crease lines 303*b*, 306*a* respectively.

Figure 6:
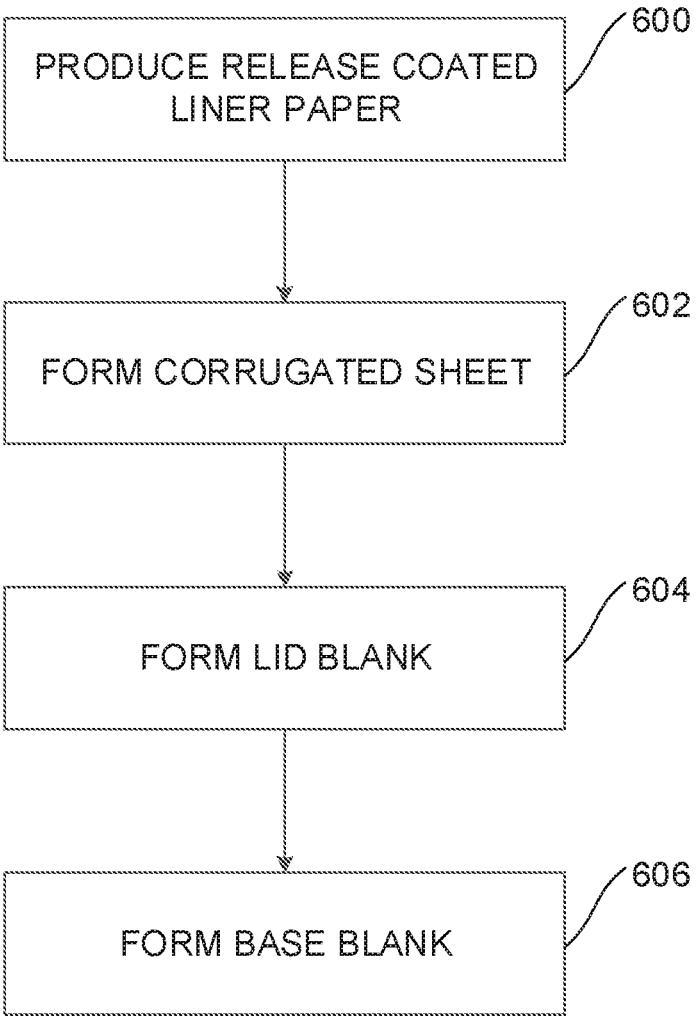
FIG. 6 is a flow chart of an example of a method of manufacturing a packaging for foodstuff.

Referring now to FIG. 6, a flow chart of an example method of manufacturing a packaging for foodstuff shall now be described. At 600, release coated liner paper is produced using a full width coated application (such as conventional rod coating or alternatively the coating is selectively applied to the paper using a pattern printing technique such as flexographic or rotogravure printing. The release coated liner paper may then be re-wound onto a reel and sent to a corrugator for production of the corrugated sheeting.

Accordingly, at 602, corrugated sheet is produced by combining the release coated inner liner paper with medium and outside liner papers that are uncoated. In this way, corrugated sheeting is produced for forming the base and lid blanks.

At 604, a base blank is formed from the release coated corrugated sheeting, said base blank adapted to be erected into a carton for containing the foodstuff therein. Depending on the coating technique used, the entire web width of the base blank may be coated or alternatively selected portions of the base blank may be coated while other parts remain uncoated. It may also be possible to use other packaging materials in forming the base blank such as solid fibre board, folding carton board, laminated board etc.

At 606, a lid blank is formed from the release coated corrugated sheeting, said lid blank adapted to form a lid that is securable to the carton so as to enclose the foodstuff within the carton in use. The release coated corrugated sheeting forming the lid blank has been selectively coated by a pattern printing process so that a surface of the lid blank that forms an internal surface of the lid is coated while at least a part of the surface of the lid blank remains uncoated to permit bonding to an uncoated surface of the carton. It may also be possible to use other packaging materials in forming the lid blank such as solid fibre board, folding carton board, laminated board etc.

In 600, it is to be understood that the release coating may be applied in one or more coats to the liner paper, of which a two coat system is an exemplary example providing both a pre-coat and a top coat as previously described.

Figure 7:
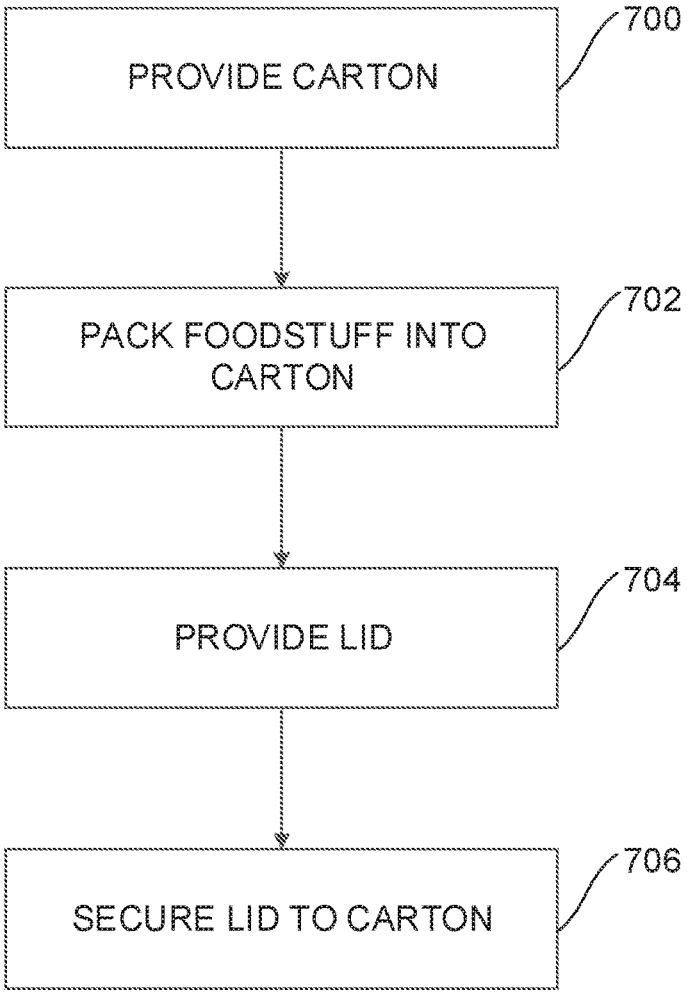
FIG. 7 is a flow chart of an example of a method of packing a foodstuff into a packaging.

Referring now to FIG. 7, there is shown flow chart of an example method of packing a foodstuff into a packaging.

At 700, the method includes providing a carton that is erected from a base blank, the carton including a release coating applied to an internal surface thereof as previously described. At 702, the foodstuff is packed into the carton. The foodstuff may include for example meat, poultry, seafood or any other food capable of freezing into a solid block.

At 704, the method includes providing a lid securable to the carton so as to enclose the foodstuff within the carton, the lid formed from a lid blank and including a release coating selectively applied to an internal surface of the lid such that at least a part of the internal surface of the lid remains uncoated to permit bonding to an uncoated surface of the carton.

Finally, at 706 the method includes securing the lid to the carton by applying an adhesive (typically glue) to the uncoated portion of the lid and bonding it to the uncoated surface of the carton. In this way, the lid becomes bonded securely to the carton forming a sealed relationship therewith.

The above described examples advantageously permit the release coating to be selectively applied to one or more of the lid and the base, whilst providing areas free of release coating that can enable the lid to be glued to the base. Whereas, packaging of the prior art including extrusion coated polymer layers tends not to be fully recyclable, the empty packaging described herein can be successfully recycled in common recycling programmes. Furthermore, the use of pattern printing to apply the release coating is highly adaptable via printing plates to multiple carton designs. The above described arrangement further enables a poly bag linerless packaging to be produced which mitigates the risk of poly entrapment Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The claims are as follows:

1. A packaging for foodstuff, including:

(a) a base blank adapted to be erected into a carton for containing the foodstuff therein, the base blank including a liner paper that forms an internal surface of the carton and which has a release coating applied thereto;

(b) a lid blank adapted to form a lid that is securable to the carton so as to enclose the foodstuff within the carton, the lid blank including:

(i) a top panel having foldable flaps around an outer periphery: and (ii) a liner paper that forms an internal surface of the lid which has a release coating selectively applied thereto such that at least a part of the internal surface of the lid blank remains uncoated, wherein the uncoated part of the internal surface of the lid blank is configured to bond to an uncoated surface of the carton, wherein, the release coating is contactable with the food stuff and capable of providing clean release therefrom;

wherein the release coating is selective' applied to the liner paper of the lid blank using a pattern printing process; and wherein at least a portion of the foldable flaps remain uncoated for bonding to an outer surface of the carton when erected.

2. The packaging according to claim 1, wherein the release coating includes:

a pre-coat; and a top coat which substantially provides the release properties.

3. The packaging according to claim 1, wherein the release coating is selectively applied to the liner paper of the base blank using the pattern printing process.

4. The packaging according to claim 1, wherein the pattern printing process is flexographic or rotogravure printing.

5. The packaging according to claim 1, wherein the printing process controls the application weight of the base coat and the top coat.

6. The packaging according to claim 5, wherein multiple applications of the base coat are applied.

7. The packaging according to claim 1, wherein the release coating is applied using the pattern printing process and wherein:

the base coat provides a uniform surface to maximise the hold of the top coat; and the application weight of the top coat is reduced or minimized.

8. The packaging according to claim 1, wherein the release coating is dyed blue to assist in visual inspection of the foodstuff and delineation between coated and uncoated areas.

9. The packaging according to claim 1, wherein the release coating is one of:

an aqueous dispersion; and solvent borne.

10. The packaging according to claim 1, wherein the release coating covers the top panel and a part of the foldable flaps.

11. The packaging according to claim 1, wherein the base blank includes gusseted corners to assist in making the erected carton leakproof.

12. The packaging according to claim 1, wherein the base blank includes:

a bottom panel;

a first pair of side panels disposed about creases along opposing short edges of the bottom panel;

a second pair of side panels disposed about creases along opposing long edges of the bottom panel; and folding gusset members disposed in respective corner rations of the base blank, the gusset members configured to fold out in overlapping relation to the first pair of side panels.

13. The packaging according to claim 12, wherein select ones of the gusset members include extending tabs which in use extend across an upper edge of the respective first pair of side panels and engage with opposing tabs to form a continuous flat surface across each respective side panel.

14. The packaging according to claim 1, wherein upper edges of the respective side panels have exposed corrugated flutes when the carton is erected.

15. The packaging according to claim 1, wherein upper edges of the respective side panels include a fold over flap when the carton is erected.

16. The packaging according to claim 1, wherein the base blank and lid blank are manufactured from corrugated paperboard.

17. The packaging according to claim 1, wherein the packaging is poly bag linerless.

18. The packaging according to claim 1, wherein the carton and lid are substantially rectangular.

19. The packaging according to claim 1, wherein the carton and lid are fully recyclable after use.

* * * * *